US006822647B1

(12) United States Patent
Kim

(10) Patent No.: US 6,822,647 B1
(45) **Date of Patent: *Nov. 23, 2004**

(54) DISPLAYS HAVING PROCESSORS FOR IMAGE DATA

(75) Inventor: Tae-Sung Kim, Kyungki-do (KR)

(73) Assignee: Samsung Electronics Co., Ltd., Suwon (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/251,942

(22) Filed: Feb. 18, 1999

(30) Foreign Application Priority Data

Feb. 18, 1998 (KR) ..... 98-4961

(51) Int. Cl.[7] ..... G09G 5/00

(52) U.S. Cl. ..... 345/213; 345/87; 345/103; 345/502; 345/531

(58) Field of Search ..... 345/98, 99, 100, 345/103, 204, 212, 213, 545, 574; 348/448, 500, 513, 521, 555, 571, 572, 520, 531

(56) References Cited

U.S. PATENT DOCUMENTS 5,119,083 A * 6/1992 Fujisawa et al. ..... 345/534
5,406,308 A * 4/1995 Shiki ..... 345/127
5,579,025 A * 11/1996 Itoh ..... 345/213
5,606,348 A * 2/1997 Chiu ..... 345/204
5,821,948 A * 10/1998 Kawamoto et al. ..... 345/507
5,861,879 A * 1/1999 Shimizu et al. ..... 345/213
5,900,857 A * 5/1999 Kuwata et al. ..... 345/100
5,929,832 A * 7/1999 Furukawa et al. ..... 345/98
6,040,826 A * 3/2000 Furukawa ..... 345/196
6,040,828 A * 3/2000 Park ..... 345/213
6,121,947 A * 9/2000 Furuhashi et al. ..... 345/98
6,177,922 B1 * 1/2001 Schiefer et al. ..... 345/213
6,229,516 B1 * 5/2001 Kim et al. ..... 345/100

FOREIGN PATENT DOCUMENTS

JP 8030236 2/1996

* cited by examiner

*Primary Examiner*—Henry N. Tran
(74) *Attorney, Agent, or Firm*—McGuireWoods LLP

(57) ABSTRACT

A display performing writing and reading operations in synchronization with different signals using a memory. A PLL (phase locked loop) circuit generates a write clock signal from a horizontal synchronization signal and transmits it to a write controller along with the horizontal synchronization signal. The write controller generates write control signals from the signals supplied by the PLL circuit to control writing of the image data into the memory. An oscillator connected to the input terminal of a read controller generates a clock signal independent of the horizontal synchronization signal for the read controller. The read controller generates read control signals using the signals from the oscillator to output into the memory and a display panel, thereby controlling reading of the image data stored in the memory. The writing and the reading of the image data are performed in synchronization with independent signals to realize stable display.

8 Claims, 5 Drawing Sheets

DISPLAYS HAVING PROCESSORS FOR IMAGE DATA

BACKGROUND OF THE INVENTION (a) Field of the Invention

The present invention relates to displays having processors for image data, in particular, to liquid crystal displays (LCDs) having processors for storing image data signals from an external device using memory and supplying the image signals to display panels.

(b) Description of the Related Art

Flat panel displays (FPDs) are increasingly used replacing cathode ray tubes (CRTs), and active matrix type LCDs having thin film transistors (TFTs) are widely used among the FPDs.

When image data are stored in a memory and outputted into a display panel, writing and reading of the data are usually synchronized with clock signals having phases synchronized with a horizontal synchronization signal or a vertical synchronization signal. The related techniques are disclosed by Shiki in U.S. Pat. No. 5,406,308. Shiki writes image data in a frame memory in synchronization with a clock signal TCK generated from a horizontal synchronization signal HSYNC supplied from an external image data signal source, and reads the image data from the frame memory in synchronization with the clock signal TCK to supply a liquid crystal display panel.

In the meantime, the speeds or the frequencies of the signals used in systems including the image data signal sources may be different from one another. For example, the frequencies of signals used in the personal computer (PC) systems are different. In particular, display control signals such as horizontal and vertical synchronization signals have various frequencies depending on the system, and the operating speeds of memories differ depending on the system. However, the speeds or the frequencies of driving integrated circuits (ICs) for displays are limited. Accordingly, if both writing and reading of the memory are synchronized with the same clock signal, the output speed from the memory to the driving IC does not depend on the operating speed of the driving IC but depends on the speed of the memory, and this may result in an abnormal operation of the driving IC.

It is an example that the frequency band of the image data signals is higher than the maximum operating frequency of the display. In this case, if both writing and reading of the memory are synchronized with the same clock signal, the reading speed is higher than the operating speed of the driving IC. This causes abnormal operation and short driving time of the driving IC and the images may not be properly displayed.

In the meantime, the reading and writing operation should be performed on time. However, as described above, the discrepancy between various operating speeds of the memories and the limited operating speed of the driving IC in the conventional LCD causes abnormal image display when the vertical refresh speed of the image signal varies.

In addition, when the external image data signals do not enter the conventional display, abnormal images such as fading are displayed on the screen, since the memory is neither read nor written onto. This lowers the reliability of the display.

These disadvantages of the conventional display is predominated in the LCDs where the charging time of the pixels are relatively slow and the driving capacity of the driving IC is limited.

SUMMARY OF THE INVENTION

It is therefore an object of the present invention to prevent abnormal operation of a conventional driving IC.

It is another object of the present invention to provide displays performing stable display regardless of the variation of the vertical synchronization signal of the external image data source.

It is another object of the present invention to provide displays which do not show abnormal image when no image signal is entered.

It is another object of the present invention to easily control displays.

These and other objects, features and advantages are provided, according to the present invention, by writing image data into a memory in synchronization with a control signal synchronized with an external signal source and reading the image data from the memory in synchronization with a control signal independent of the external signal source.

The control signal used in reading the image data is also used for the various signals of the display, i.e., the various signals of the display are divided by the control signal used in reading the image data, and thus the operating speed of the display is always in harmony with the reading speed of the image data, thereby realizing stable images.

Furthermore, the image data read from the memory are in a format suitable for display in writing or reading, to simplify the image processing.

In detail, a display according to the present invention includes a memory storing image data from an external source and a display panel that receives the image data from the memory and displays images. The display also includes a signal generator generating a fist clock signal synchronized with a display control signal from the external source. A write controller generates a write control signal, synchronized with the first clock signal, to control writing of the image data into the memory. An oscillator generates a second clock signal independent of the display control signal, and a read controller generates a read control signal, synchronized with the second clock signal, to control reading of the image data from the memory.

It is preferable that the image data stored in the memory is output in a format determined by the display panel, and it is obtained by using at least one of the write control signal and the read control signal.

It is also preferable that the display panel is driven by the read control signal.

When the display panel is a liquid crystal panel, it is driven in twice-divided mode. In a twice-divided mode, the frequency cycle is reduced to half. For example, when a device operates at a speed of 60 MHz in a normal mode, it operates at a speed of 30 MHz in a twice-divided mode, effectively slowing down the device. Furthermore, the liquid crystal display panel is driven in dual-scanning mode.

The memory preferably has a frame memory.

The display panel may include a device for receiving image data and a device for receiving the read control signal, and the display includes an analog/digital converter converting the image data in an analog format into a digital format when the image data from the external source are in an analog format.

DETAILED DESCRIPTION OF THE PREFERRED EMBODIMENTS

The present invention will now be described more fully hereinafter with reference to the accompanying drawings, in which preferred embodiments of the present invention are shown. This invention may, however, be embodied in different forms and should not be construed as limited to the embodiments set forth herein.

Figure 1:
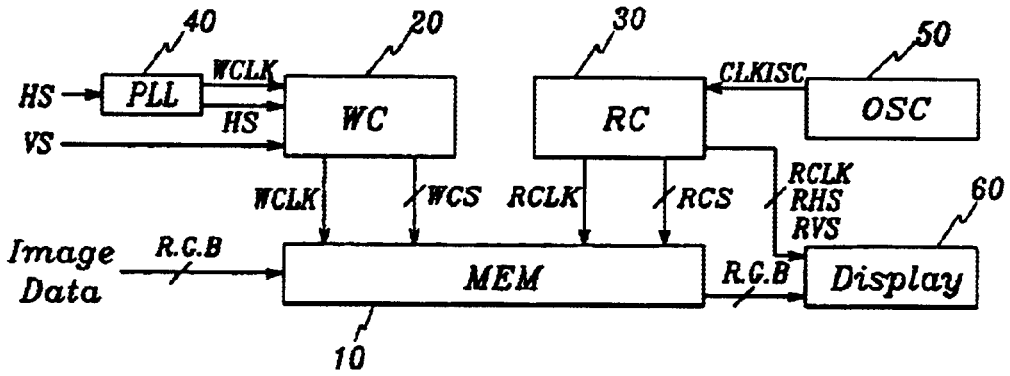
FIG. 1 is a block diagram of an image data processor of a display according to a first embodiment of the present invention.

FIG. 1 is a block diagram of an image data processor of a display according to a first embodiment of the present invention.

As shown in FIG. 1, a write terminal and a read terminal of a memory 10, which temporarily stores digital image data provided from an external image data source such as a graphic card of a personal computer, are respectively connected to output terminals of a write controller (WC) 20 and a read controller (RC) 30. The write controller 20 and the read controller 30 control the writing into and the reading from the memory 10. The write controller 20 is connected to an output terminal of a phase locked loop (PLL) circuit 40. The PLL circuit 40 generates a write clock signal WCLK in synchronization with external display control signals such as a horizontal synchronization signal HS and outputs the write clock signal WCLK as well as the external display control signals. A read controller 30 is connected to an oscillator 50 generating a clock signal CLKOSC which is independent of the external display control signals. A controller (not shown) of a display 60 is connected to output terminals of the memory 10 and the read controller 30, and read the image data stored in the memory 10 responsive to the signals from the read controller 30. In particular, the controller of the display 60 controls the display 60 by generating control signals derived from or in synchronization with the signals from the read controller 30.

The memory 10 may include various storing devices, and it is preferable to use frame memories.

Now, the operation of the image data processor for the display is described with reference to FIGS. 1 to 4.

Figure 2:
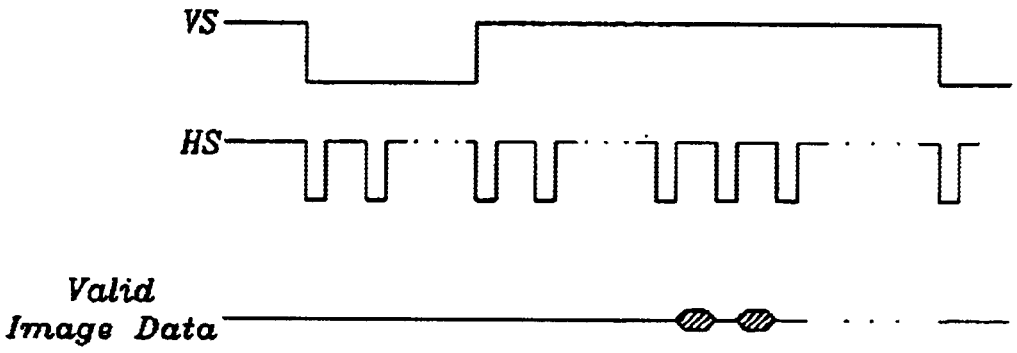
FIG. 2 shows wave forms of display control signals and an image signal supplied to the image data processor according to the first embodiment of the present invention.

FIG. 2 shows waveforms of signals entering the processor from an external source. The illustrated waveforms are a vertical synchronization signal VS, a horizontal synchronization signal HS and valid image data. The valid image data means the data which will be actually stored in the memory.

Figure 3:
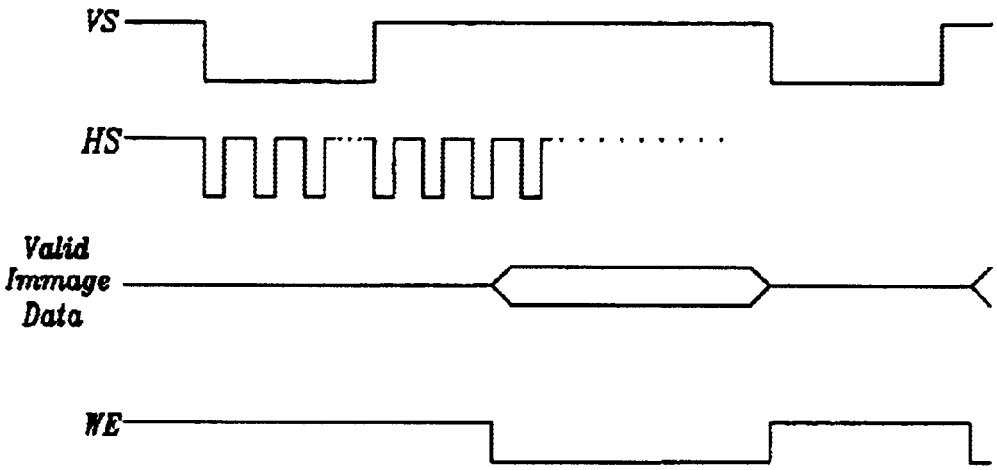
FIG. 3 illustrates waveforms of display control signal and an image signal related to writing according to the first embodiment of the present invention.

FIG. 3 shows wave forms of signals related to writing operation into the memory 10 such as a vertical synchronization signal VS, a write clock signal WCLK, valid image data and a write enable signal WE.

Referring to FIGS. 2 and 3, when the horizontal synchronization signal HS enters the PLL circuit 40, the PLL circuit 40 generates a write clock signal WCLK and supplies the write clock signal WCLK along with the horizontal synchronization signal HS to the write controller 20. The write clock signal WCLK is phase-divided from the horizontal synchronization signal HS, and has the same phase as the horizontal synchronization signal HS.

The vertical synchronization signal VS is directly supplied to the write controller 20.

However, the write clock signal WCLK may be made from the vertical synchronization signal VS, and, in this case, the horizontal synchronization signal HS is directly applied to the write controller 20.

The write controller 20 generates a write control signal WCS using the horizontal and the vertical synchronization signals HS and VS and the write clock signal WCLK, and outputs the write control signal WCS as well as the write clock signal WCLK to control the writing of the image data into the memory 10.

The image data signals are red, green and blue color signals. The image data signals in digital format may be directly stored in the memory 10 but those in an analog format such as TV (television) signals are first converted into the digital signals and then stored in the memory 10.

As shown in FIG. 3, after a pulse of the vertical synchronization signal VS is generated and a few pulses of the write clock signal WCLK pass by, the write enable signal WE becomes a low level. While the write enable signal WE maintains its low level, the image data is stored whenever the write clock signal WCLK becomes high level. In a case that the memory is divided into a plurality of blocks and the image data are stored in the corresponding blocks, a plurality of write enable signals are used to store the respective image data in the desired blocks, which will be described in a second embodiment.

Next, the reading operation is described with reference to FIG. 4 which shows wave forms of the signals related to the reading from the memory 10.

First, the oscillator 50 such as a crystal oscillator generates a clock signal CLKOSC, which has a predetermined period and runs independent of both of the horizontal synchronization signal HS and the vertical synchronization signal VS. The clock signal CLKOSC is supplied to the read controller 30.

The read controller 30 generates a read clock signal RCLK from the clock signal CLKOSC. The read clock signal RCLK may be the clock signal CLKOSC or derived from the clock signal CLKOSC. In FIG. 4, the frequency of the read clock signal RCLK is divided to half from the frequency of the clock signal CLKOSC. The read controller 30 generates a read horizontal synchronization signal RHS divided from the read clock signal RCLK by the sum of the vertical resolution of the external input signal source and the marginal number of the system design. The read controller 30 generates a read vertical synchronization signal RVS divided from the read horizontal synchronization signal RHS by the sum of the horizontal resolution of the external input signal source and the marginal number of the system design. The read controller 30 also generates a read enable signal RE which is activated after a pulse of the read vertical synchronization signal RVS is generated and a number of the pulses of the read clock signal RCLK pass by. The read controller 30 outputs read control signals including the read enable signal RE as well as the read clock signal RCLK to the memory 10. The read controller 30 also outputs the read horizontal synchronization signal RHS and the read vertical synchronization signal RVS as well as the read clock signal RCLK to the display, thereby controlling the reading operation. The signals entering the display 60 such as the read horizontal synchronization signal RHS, the read vertical synchronization signal RVS and the read clock signal RCLK are generated to fit the display 60.

The reading operation begins with the activation of the read enable signal RE. The read enable signal is activated a few pulses of RCLK after a pulse of the read horizontal synchronization signal RHS is generated. While the read enable signal RE maintains its low level, the image data stored in the memory 10 is read into the display 60 in synchronization with the rising edge of the read clock signal RCLK.

Figure 4:
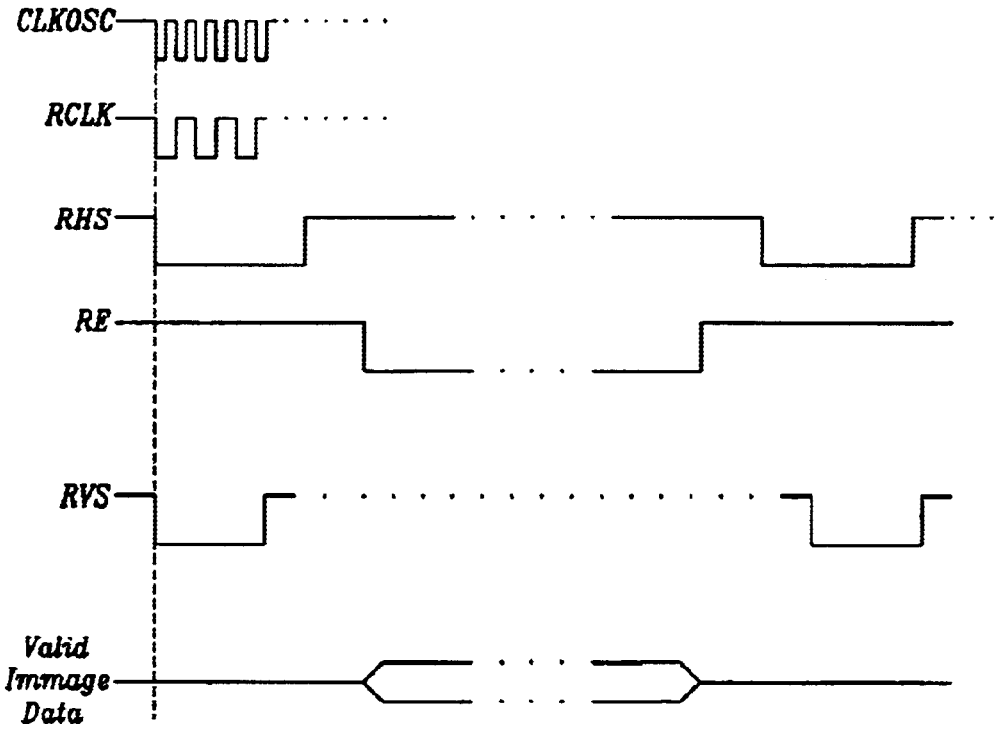
FIG. 4 shows wave forms of display control signal and an image signal related to reading according to the first embodiment of the present invention.

If the input format and the output format of the signals are the same, the image data are output according to the sequence of the horizontal period as shown in FIG. 4. However, if the display has a special format, the read control signal and/or the write control signal suitable for the display 60 is provided, and the write or read sequences of the image data are changed or the image data is grouped to output such that the format of the read image data is suitable for the display. Using frame memories may be proper for this purpose.

As described above, the image data stored in the memory is read in the optimized format regardless of the refresh period of the external signal source, and the display is controlled by input signals read into the controller of the display. Accordingly, the display is operated in an optimum frequency without depending on the external signal source. In addition, the display shows stable image since the reading operation from the memory is not affected even though the external signal source is abnormal.

Next, a liquid crystal display having an image data processor according to the present invention is described with reference to FIGS. 5 to 9.

This embodiment adapts a memory suitable for a liquid crystal display and provides an image data processor which formats color signals from an external device and then stores in and reads from the memory.

Figure 5:
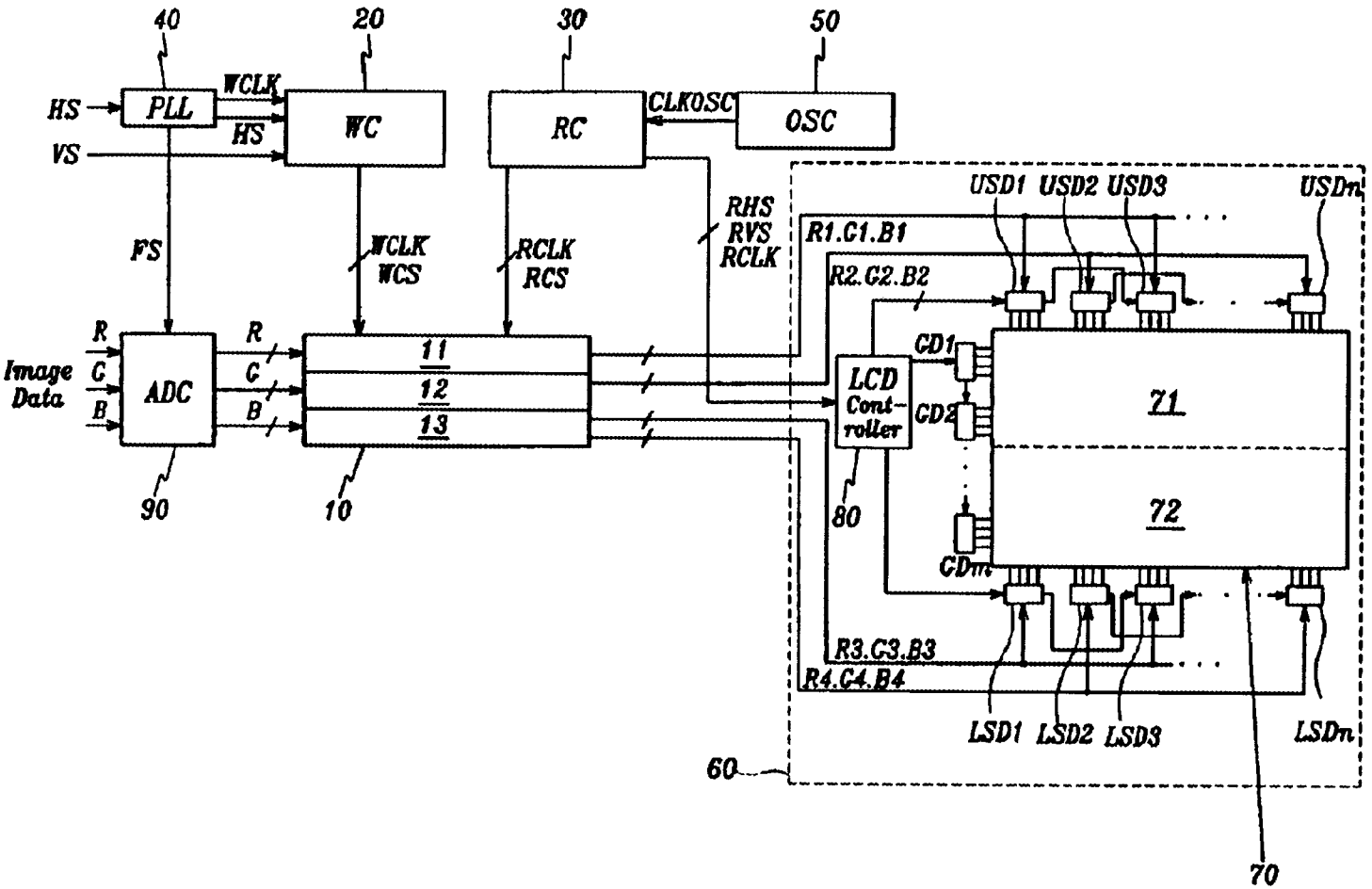
FIG. 5 is a block diagram of an image data processor of a liquid crystal display according to a second embodiment of the present invention.

As shown in FIG. 5, a liquid crystal display 60 includes a panel 70, a plurality of gate and source drivers GD1, . . . , GDm; USD1, . . . , USDn; LSD1, . . . , LSDn, and an LCD controller 80. The panel 70 includes an upper substrate 71 and a lower substrate 72, and each of the upper and the lower substrates 71 and 72 has a plurality of vertical signal lines and a plurality of horizontal signal lines. Some of the plurality of the gate drivers GD1, . . . , GDm are connected to the horizontal signal lines of the upper substrate 71, and the remaining gate drivers are connected to the horizontal signal lines of the lower substrate 71. Upper source drivers UDS1, . . . , USDn are located at the upper parts and outside of the panel 70. Lower source drivers LSD1, . . . , LSDn are located at the lower parts and outside of the panel 70. Upper source drivers and lower source drivers are respectively connected to the vertical signal lines of the upper substrate 71 and the lower substrate 72. Accordingly, the LCD according to this embodiment takes dual scanning mode where the upper substrate 71 and the lower substrate 72 are driven simultaneously and independently. The odd drivers USD1, USD3, . . . ; LSD1, LSD3, . . . and the even drivers USD2, USD4, . . . ; LSD2, LSD4, . . . are connected to the memory 10 via different signal lines, and the LCD is driven in twice-division type.

The red, green and blue color signals R, G and B from an external signal source such as PC are analog signals in this embodiment. Therefore, the analog is color signals are converted into digital signals by an analog/digital converter (ADC) 90 located prior to a memory 10. A PLL circuit 40 generates a sampling frequency signal FS using a write clock signal WCLK or a clock signal divided from the write clock signal WCLK and send it to the analog/digital converter 90. The ADC 90 samples the external color signals and transmits them to the memory 10 in synchronization with the sampling frequency signal FS.

A write controller 20, as the first embodiment, controls the writing into the memory by providing write control signals such as a write enable signal WE as well as the write clock signal WCLK after receiving a horizontal synchronization signal HS and the write clock signal WCLK from the PLL circuit 40. At this time, a plurality of write control signals are generated to store the image data according to the desired format. This embodiment uses frame memories as a memory for this end.

Figure 6:
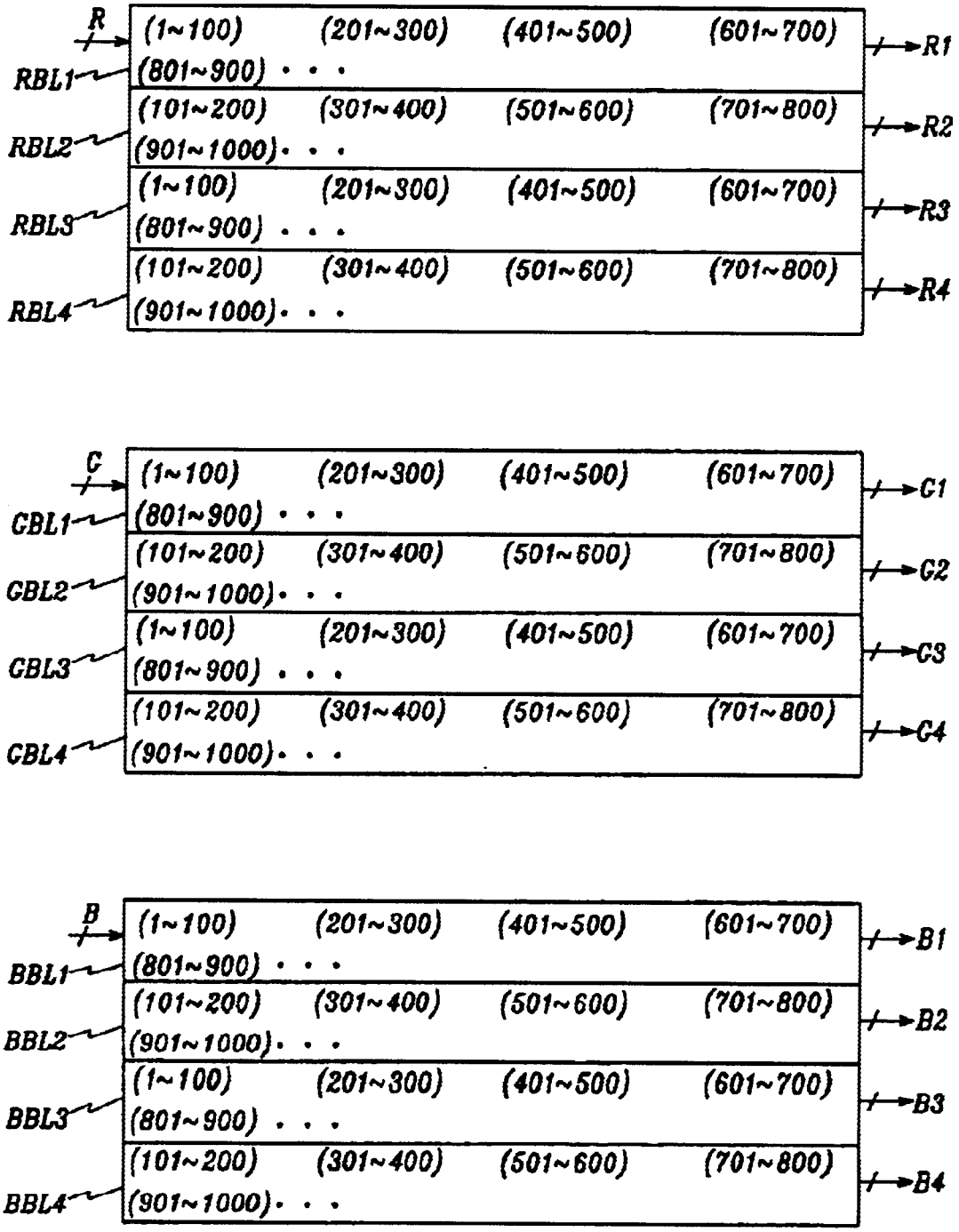
FIG. 6 is a block diagram showing a method for storing image data in a memory according to a first embodiment of the present invention.

The memory 10 is a frame memory which is divided into three blocks 11, 12 and 13 respectively storing red, green and blue color signals as shown in FIG. 5. Each block 11, 12 or 13 has four sub-blocks RBL1, . . . , RBL4; GBL1, . . . , GBL4; and BBL1, . . . , BBL4 as shown in FIG. 6. The respective sub-blocks store image data which will be provided to the upper odd source drivers USD1, USD3, . . . , the upper even source drivers USD2, USD4, . . . , the lower odd source drivers LSD1, LSD3, and the lower even source drivers LSD2, LSD4, . . . , respectively.

In case of an SVGA LCD, since the number of the vertical signal lines transmitting color signals are 800 for each color, the respective number of the vertical signal lines of the upper substrate 71 and the lower substrate 72 is 2,400, totaling the number of the vertical signal lines to be 4,800. If the number of the output terminals of each source driver is 100, and if the sequence numbers are assigned to the vertical signal lines from the upper substrate 71 to the lower substrate 72, a method for storing image data by unit of blocks are suggested. That is, the first sub-block RBL1 among the four sub-blocks RBL1, . . . , RBL4 storing the red color signals stores the signal which will be applied via upper odd source drivers USD1, USD3, . . . , i.e., the image data via the vertical signal lines transmitting the red color signals to first to 100th pixels, 201st to 300th pixels and so on. The second sub-block RBL2 stores the signal which will be applied via upper even source drivers USD2, USD4, . . . , i.e., the image data via the vertical signal lines transmitting the red color signals to 101st to 200th pixels, 301st to 400th pixels and so on. In the same way, the third sub-block RBL3 stores the signal which will be applied via lower odd source drivers LSD1, LSD3, . . . , and the fourth sub-block RBL4 stores the signal which will be applied via lower even source drivers LSD2, LSD4, . . .

The sub-blocks of GBL1, . . . , GBL4; and BBL1, . . . , BBL4 also store the image data in the same manner.

Although this embodiment adapts a memory having blocks, each block may be a single memory device.

Figure 7:
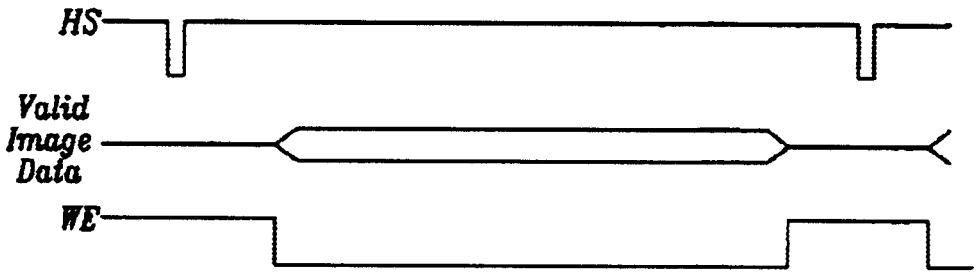
FIGS. 7 to 9 illustrate waveforms of signals according to the second embodiment of the present invention.

The writing operation into the memory 10 is similar to that in the first embodiment. That is, after a pulse of the horizontal synchronization signal HS is generated and a few pulses of the write clock signal WCLK (as shown in FIG. 3) pass by, the write enable signal WE becomes a low level, as shown in FIG. 7. While the write enable signal WE maintains its low level, the image data is stored into the memory in synchronization with the write clock signal WCLK.

Figure 8:
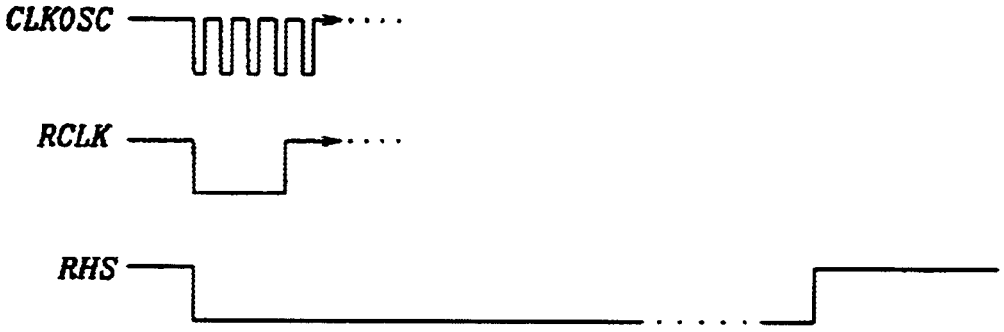

The reading operation into the memory 10 is also similar to that in the first embodiment. In detail, the oscillator 50 such as a crystal oscillator generates an clock signal CLKOSC, which depends neither on the horizontal synchronization signal HS nor the vertical synchronization signal VS, and transmits it into the read controller 30. As shown in FIG. 8, the read controller 30 generates a read clock signal RCLK, a read horizontal synchronization signal RHS and a read vertical synchronization signal RVS (as shown in FIG. 4) and read control signals, which are synchronized with the CLKOSC. The read controller 30 outputs the read control signal RCS as well as the read clock signal RCLK into the memory 10 to control the reading from the memory 10, and outputs the read horizontal synchronization signal RHS and the read vertical synchronization signal RVS as well as the read clock signal RCLK to the LCD controller 80.

This will be described in detail with reference to the waveforms shown in FIG. 9.

Figure 9:
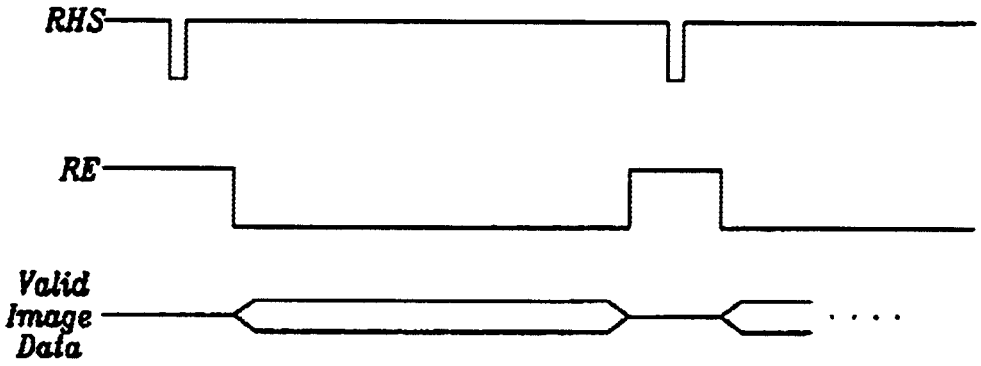

As shown in FIG. 9, the read enable signal RE, one of the read control signals, becomes activated a few pulses of read clock signal RCLK after a pulse of the read horizontal synchronization signal RHS is generated. The read enable signal RE simultaneously enters into the twelve sub-blocks and the color signals stored in the sub-blocks are simultaneously read out.

Although the data in each sub-block are serially output, the data in the twelve sub-blocks are output in parallel. At this time, the image data R1, G1 and B1 stored in the first sub-blocks RBL1, GBL1 and BBL1 of the blocks 11, 12 and 13 are simultaneously output to enter the upper odd source drivers USD1, USD3, . . . ; the image data R2, G2 and B2 stored in the second sub-blocks RBL2, GBL2 and BBL2 are simultaneously output to enter the upper even source drivers USD2, USD4, the image data R3, G3 and B3 stored in the third sub-blocks RBL3, GBL3 and BBL3 are simultaneously output to enter the lower odd source drivers LSD1, LSD3, . . . ; and the image data R4, G4 and B4 stored in the fourth sub-blocks RBL4, GBL4 and BBL4 are simultaneously output to enter the lower even source drivers LSD2, LSD4, . . . As a result, four groups of color signals are output at the same time.

The LCD controller 80 controls the gate drivers GD1, . . . , GDm and the source drivers USD1, . . . , USDn; and LSD1, . . . , LSDn to display images.

As described above, this embodiment takes the dual-scanning mode and writes into and reads from the memory in harmony with the formats of the LCD which drives the source drivers in the twice-divided mode. This embodiment stores the image data using a three-block memory device, each block having four sub-blocks. Three memory devices with four blocks or twelve memory devices may be used, too. This embodiment generates and uses the write enable signal and the read enable signal suitable for the memory structure.

However, it is another embodiment that the color signals are stored in the input sequence without any format but can be read out using suitable read control signals, thereby obtaining the same output results as the above described embodiments. It is another embodiment that both writing and reading are performed in some formats to obtain the similar results.

What is claimed is:

1. A display comprising:

a memory storing image data from an external source;

a signal generator generating a first clock signal synchronized with a display control signal from the external source;

a write controller generating a write control signal synchronized with the first clock signal and controlling writing of the image data into the memory;

an oscillator generating a second clock signal independently from the display control signal;

a read controller generating a read clock signal synchronized with the second clock signal and provided to the memory and a read control signal synchronized with the read clock signal and controlling reading of the image data from the memory; and a display panel receiving the read clock signal from the read controller and the image data from the memory and displays displaying images, wherein the image data are output in a format determined by the display panel.

2. The display of claim 1, wherein the display panel is a liquid crystal panel.

3. The display of claim 2, wherein the display panel is driven in a twice-divided mode.

4. The display of claim 2, wherein the display panel is driven in a dual-scanning mode.

5. The display of claim 4, wherein the memory comprises a frame memory.

6. The display of claim 2, wherein the output of the image data in the format determined by the display panel is obtained by using at least one of the write control signal and the read control signal.

7. The display of claim 2, wherein the display panel comprises a device for receiving image data and a device for receiving the read control signal.

8. The display of claim 1, further comprising an analog/digital converter converting analog image data into digital image data.

* * * * *